United States Patent [19]

Price

[11] 4,030,443

[45] June 21, 1977

[54] SPORTS WATERCRAFT

[76] Inventor: Donald C. Price, 23844 Gratiot, East Detroit, Mich. 48205

[22] Filed: Mar. 29, 1976

[21] Appl. No.: 671,628

[52] U.S. Cl. ..... 115/70

[51] Int. Cl.[2] ..... B63B 35/00

[58] Field of Search ..... 115/70; 114/66.5 H

[56] References Cited

UNITED STATES PATENTS

| | | | |
|---|---|---|---|
| 2,817,101 | 12/1957 | Chaffee | 115/70 |
| 3,394,673 | 7/1968 | Hamori | 115/70 |
| 3,570,444 | 3/1971 | Farr | 115/70 |
| 3,703,877 | 11/1972 | Ueda | 115/70 |
| 3,827,391 | 8/1974 | Stanberry, Sr. et al. | 115/70 |
| 3,888,204 | 6/1975 | Zubick, Jr. | 115/70 |

*Primary Examiner*—Trygve M. Blix
*Assistant Examiner*—Jesus D. Sotelo
*Attorney, Agent, or Firm*—William L. Fisher

[57] ABSTRACT

Improvement in sports watercraft having a floatable hull, a propeller system including a rotatable propeller shaft and propeller for propelling the watercraft in water, a motor for driving the propeller, a throttle for controlling the speed of the motor and steering mechanism for rotating the propeller shaft to steer the watercraft in water, the improvement comprising a water ski disposed beneath and joined to the hull so that at low speeds the water craft floats in the water by means of the hull and at high speeds the hull is lifted entirely out of the water by means of the water ski, whereby at high speeds the watercraft rides on top of the water, the hull having a flat deck portion for supporting an occupant of the watercraft in a straddling position, a foot rest on both sides of the hull for supporting the feet of the occupant, the water ski joined to the hull by a rib structure which spaces the water ski from the bottom of the hull.

2 Claims, 5 Drawing Figures

SPORTS WATERCRAFT

IMPROVEMENTS IN SPORTS WATERCRAFT

Figure 1:
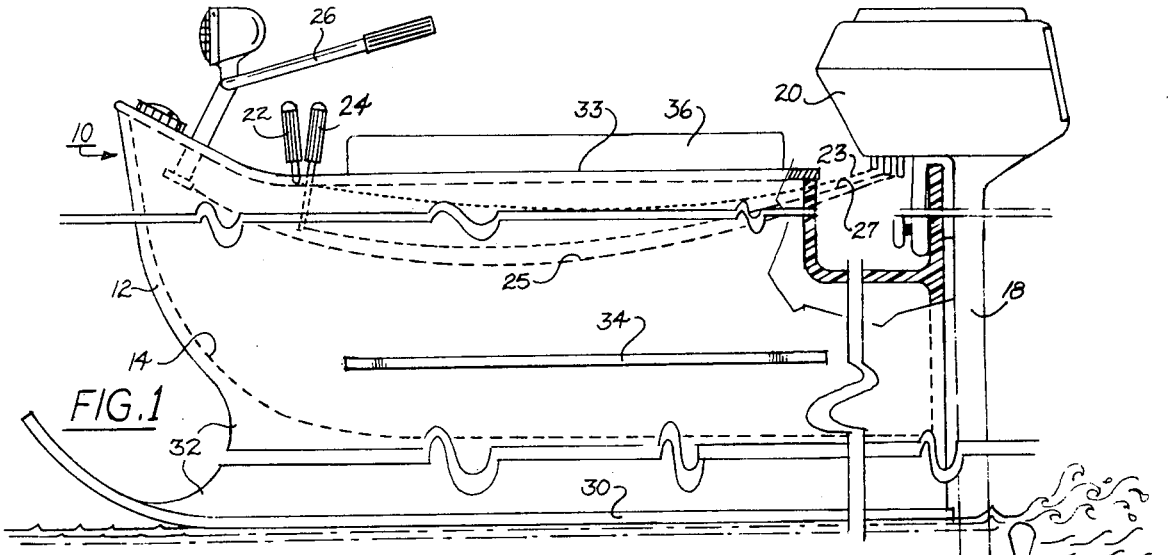
Figure 2:
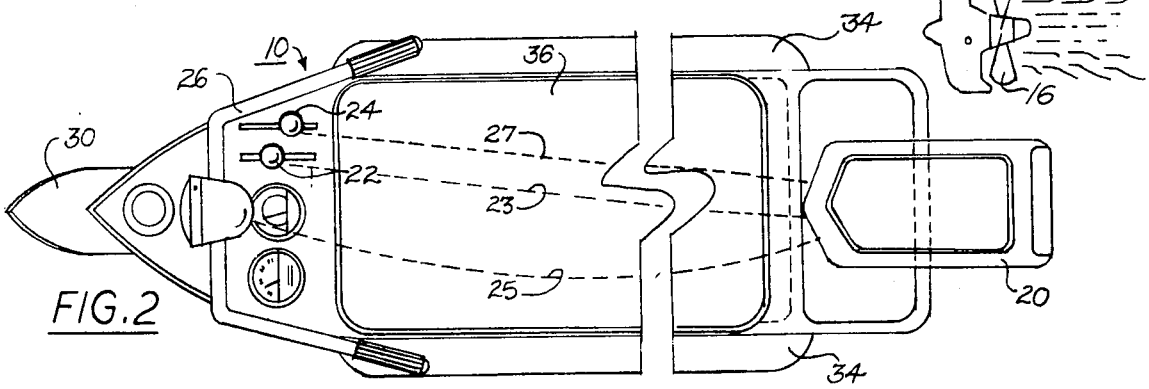
Figure 3:
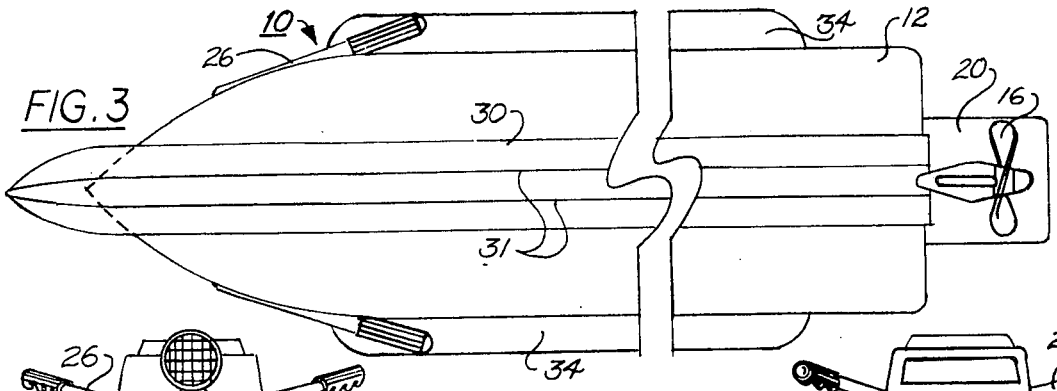
Figure 4:
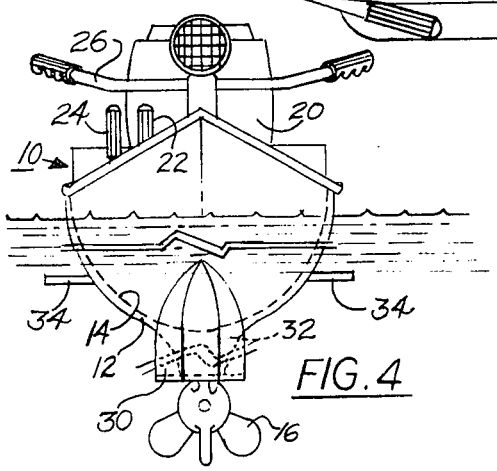
Figure 5:
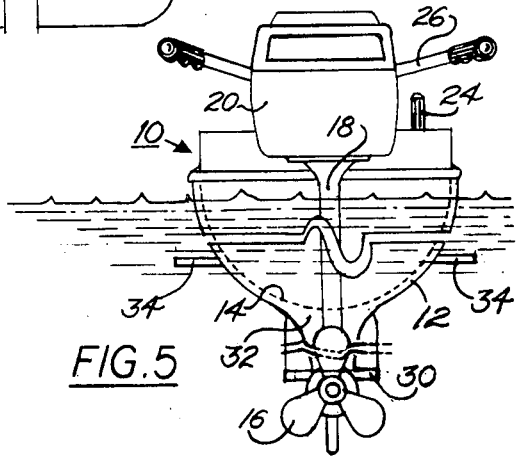

My invention relates to sports watercraft.

The principal object of my invention is to provide improvements in sports watercraft by which said watercraft floats in the water at low speeds and rides on top of the water at high speeds.

The foregoing object of my invention and the advantages thereof will become apparent during the course of the following description, taken in conjunction with the accompanying drawings, in which:

FIGS. 1–5 are, respectively, side elevational, top and bottom plan, and front and rear elevational views of a sports watercraft embodying my invention.

Referring to the drawing in greater detail, 10 generally designates said embodiment which comprises a sports watercraft having a floatable hull 12 which is hollow, as at 14, propeller means having a propeller 16 and a rotatable propeller shaft (not shown) disposed in a housing 18, a motor 20 for driving said propeller 16, a throttle 22 having a cable connection 23 with the motor 20 for controlling the speed thereof, steering mechanism having a cable connection 25 with the propeller shaft for rotating the same. A transmission means having a cable connection 27 with the propeller 16 for reversing the same is shown as an available option. Said steering mechanism, in the instance, comprises a swivelably mounted handle bar 26 which causes the propeller shaft to rotate oppositely thereof via said cable connection 27.

The foregoing structure is entirely conventional and my improvement comprises a water ski 30 disposed beneath and joined to said hull 12 so that at low speeds the watercraft 10 floats in the water by means of the hull 12 and at high speeds said hull 12 is lifted entirely out of the water by means of the water ski 30, whereby at said high speeds said watercraft 10 rides on top of the water.

Said water ski 30 has a conventional shape and structure including grooving 31 in the bottom surface thereof and is joined to said hull 12 by a solid rib structure 32 having a length substantially equal to that of said hull 12 and a width equal to or narrower than that of said water ski 30. The height of the rib structure 32 must be sufficient to raise the hull 12 entirely out of the water at high speeds so that the watercraft 10 rides entirely on the water ski 30 on top of the water. The length of the propeller shaft and housing 18 must be sufficient to maintain the propeller 16 in water at all speeds of the watercraft 10. Said hull 12 has a flat deck portion 33 for supporting an occupant of said watercraft in a straddling position and means 34 on both sides of said hull 12 for supporting the feet of said occupant. Said deck portion 33 which is provided with a cushion 36 is sufficiently long to support more than one occupant at a time. Said supporting means 34, in the instance, projects laterally outwardly of said hull 12 and extends lengthwise thereof for supporting the feet of all said occupants.

In operation of said watercraft 10, at low speeds the same floats in the water by means of said hull 12 and at high speeds said watercraft 10 is lifted out of the water and rides on top thereof by means of said water ski 30. In FIG. 1 the watercraft 10 is shown in a horizontal position for convenience of illustration but it will be appreciated that in actual use the watercraft 10 will dip backwardly as the speed thereof increases so that to maintain the watercraft 10 riding on top of the water it actually dips backwardly considerably though this actual position is not shown in FIG. 1. In this connection it may be well to note that in taking the hull 12 out of the water the greatest amount of power is consumed and that less power is required to maintain the watercraft riding on top of the water.

It will thus be seen that there has been provided by my invention improvements in sports watercraft in which the object hereinabove set forth, together with many thoroughly practical advantages, has been successfully achieved. While a preferred embodiment of my invention has been shown and described, it should be understood that variations and changes may be resorted to without departing from the spirit of my invention as defined by the appended claims.

What I claim is:

1. Improvement in sports watercraft having a floatable hull, a propeller means including a rotatable propeller shaft and propeller for propelling said watercraft in water, a motor for driving said propeller, a throttle for controlling the speed of said motor and steering mechanism for rotating the propeller shaft to steer said watercraft in water, said improvement comprising the bottom portion of said hull being rounded in shape like a boat and formed with an exterior radius to provide maximum bouyancy for a given depth of displacement of said hull, the interior of the said hull having a radius with the same center as said exterior radius, said motor and propeller being exterior of said hull, a single water ski disposed beneath and joined to said hull so that at low speeds said watercraft floats in the water by means of said hull and at high speeds said hull is lifted substantially entirely out of the water by means of said water ski, whereby at said high speeds said watercraft rides on top of the water, said hull having a flat deck portion for supporting an occupant of said watercraft in a straddling position, and means on both sides of said hull for supporting the feet of said occupant, a single rib structure, said water ski joined to said hull by said rib structure which spaces said water ski from the bottom of said hull, the width of said rib structure being no greater than that of said water ski, said water ski being formed in one continuous piece from end to end thereof over its entire length, said rib structure being formed integral with said hull and in one continuous piece from end to end thereof over its entire length, said water ski joined solidly to said rib structure continuously over the entire length of the latter, there being no break or interruption in either said rib structure or said water ski over the entire length thereof.

2. Improvement as claimed in claim 1, said flat deck portion being sufficiently long to support more than one occupant at a time, said supporting means on the sides of said hull extending lengthwise thereof for supporting the feet of all said occupants.

* * * * *